US006496095B2

(12) United States Patent
Yu

(10) Patent No.: US 6,496,095 B2
(45) Date of Patent: Dec. 17, 2002

(54) SWITCH WITH AN OVERRIDE INTERRUPTION STRUCTURE

(76) Inventor: Tsung-Mou Yu, No. 4, Alley 2, Lane 23, Sec. 3, Pa Te Rd., PahChiao City, Taipei Hsien (TW)

( * ) Notice: Subject to any disclaimer, the term of this patent is extended or adjusted under 35 U.S.C. 154(b) by 97 days.

(21) Appl. No.: 09/803,521

(22) Filed: Mar. 8, 2001

(65) Prior Publication Data

US 2002/0125981 A1 Sep. 12, 2002

(51) Int. Cl.[7] ..... H01H 37/02; H01H 37/32; H01H 37/46; H01H 37/52

(52) U.S. Cl. ..... 337/66; 337/59; 337/62; 337/85; 337/113

(58) Field of Search ..... 337/367, 59, 62, 337/66, 76, 79, 53, 67–69, 74, 75, 39, 85, 91, 112, 113, 140, 334, 345; 200/553–557; 29/622

(56) References Cited

U.S. PATENT DOCUMENTS 4,068,203 A * 1/1978 Unger ..... 337/107
4,363,016 A * 12/1982 Unger ..... 337/56
4,661,667 A * 4/1987 Sorimachi et al. ..... 200/313
4,704,594 A * 11/1987 Krasser ..... 337/66
4,931,762 A * 6/1990 Fierro ..... 337/66
5,153,552 A * 10/1992 Krasser ..... 337/66
5,157,369 A * 10/1992 Yao ..... 337/62
5,262,748 A * 11/1993 Tsung-Mou ..... 337/66
5,786,742 A * 7/1998 Yin ..... 337/347
5,854,585 A * 12/1998 Kingma ..... 337/343
5,936,505 A * 8/1999 Yu ..... 200/310
6,121,868 A * 9/2000 Chiang ..... 333/112
6,229,426 B1 * 5/2001 Lavado et al. ..... 218/117

FOREIGN PATENT DOCUMENTS

DE 3313465 A1 * 10/1984 ..... H01H/73/30
FR 2766007 A1 * 1/1999 ..... H01H/13/14

* cited by examiner

*Primary Examiner*—Anatoly Vortman

(57) ABSTRACT

A push button switch includes a box with a button movably inserted in the box and an oscillation member is pivotally connected to a terminal plate. A bimetal plate is connected to the other terminal plate. A curved spring is connected to the oscillation member and a tongue of the button contacts the curved spring so that the bimetal plate contacts the oscillation member when pushing the button. A movable member has a U-shaped member which has an end engaged with an enclosed recessed area in the button. The inner periphery of the recessed area positions the end of the U-shaped member at open and close position. The movable member is pushed by the deformation of the bimetal plate and the U-shaped member is moved from the position in the recessed area.

8 Claims, 7 Drawing Sheets

SWITCH WITH AN OVERRIDE INTERRUPTION STRUCTURE

FIELD OF THE INVENTION

The present invention relates to a push button switch that has simple structure and having an override interruption structure so as to automatically open the circuit in case of the override.

BACKGROUND OF THE INVENTION

Many conventional push buttons with an override interruption structure known to applicant are disclosed in U.S. Pat. Nos. 5,786,742, 5,223,813, 4,937,548, 4,661,667, 5,223,813, 4,931762, 5,451,729 and 4,704,594. U.S. Pat. No. 4,937,548. A thermally deformed bimetal plate is used to open circuit in case of the override. However, the action to open the circuit takes time because the structure for disengagement two contact points is indirectly operated by the bimetal plate so that there is a possibility that the electric current will destroy the electric equipment in case of the override. Furthermore, an additional wire is required between the bimetal plate and a conductive plate. In U.S. Pat. No. 5,786,742, the button is directly connected to the contact point so that the open action for the circuit is not fast enough to timely protect the equipment.

The present invention intends to provide a push button switch that has a simple structure and timely opens the circuit to protect the electric equipment.

SUMMARY OF THE INVENTION

In accordance with one aspect of the present invention, there is provided a push button switch comprising box having a button movably inserted in an open top of the box. A tubular member extends from an underside of the button and a spring is biased between the tubular member and the box. A tongue extends from an underside of the button and a recessed area is defined in a surface of the tubular member. The recessed area has a polygonal inner periphery and a central member is located in a center of the recessed area. A first terminal plate and a second terminal plate respectively extend from a bottom of the box. A board extends from an inner side of the box and a hole is defined in a surface of the board. Two rods respectively extend from the inner side of the box.

A movable member has two slots and the rods are movably received in the two slots. A U-shaped member has a leg extending through the movable member and engaged with the recessed area. The other leg of the U-shaped member is inserted in the hole in the board. A U-shaped bimetal plate has a central plate located between two legs of the U shaped bimetal plate and a first contact point is connected to the central plate. The two legs of the bimetal plate is fixedly connected to a top of the first terminal plate. The bimetal plate is located beside an end of the movable member. An oscillation member has a first end pivotally connected to the second terminal plate and a second end of the oscillation member has a second contact point connected thereto. A curved spring has an end fixedly connected to the box and the other end of the curved spring is connected to the oscillation member. The tongue contacts the curved spring.

The object of the present invention is to provide a switch that has a movable member which is pushed by the bimetal plate in case of the override and the movement of the movable member shifts a U-shaped member to let the button to jump up.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
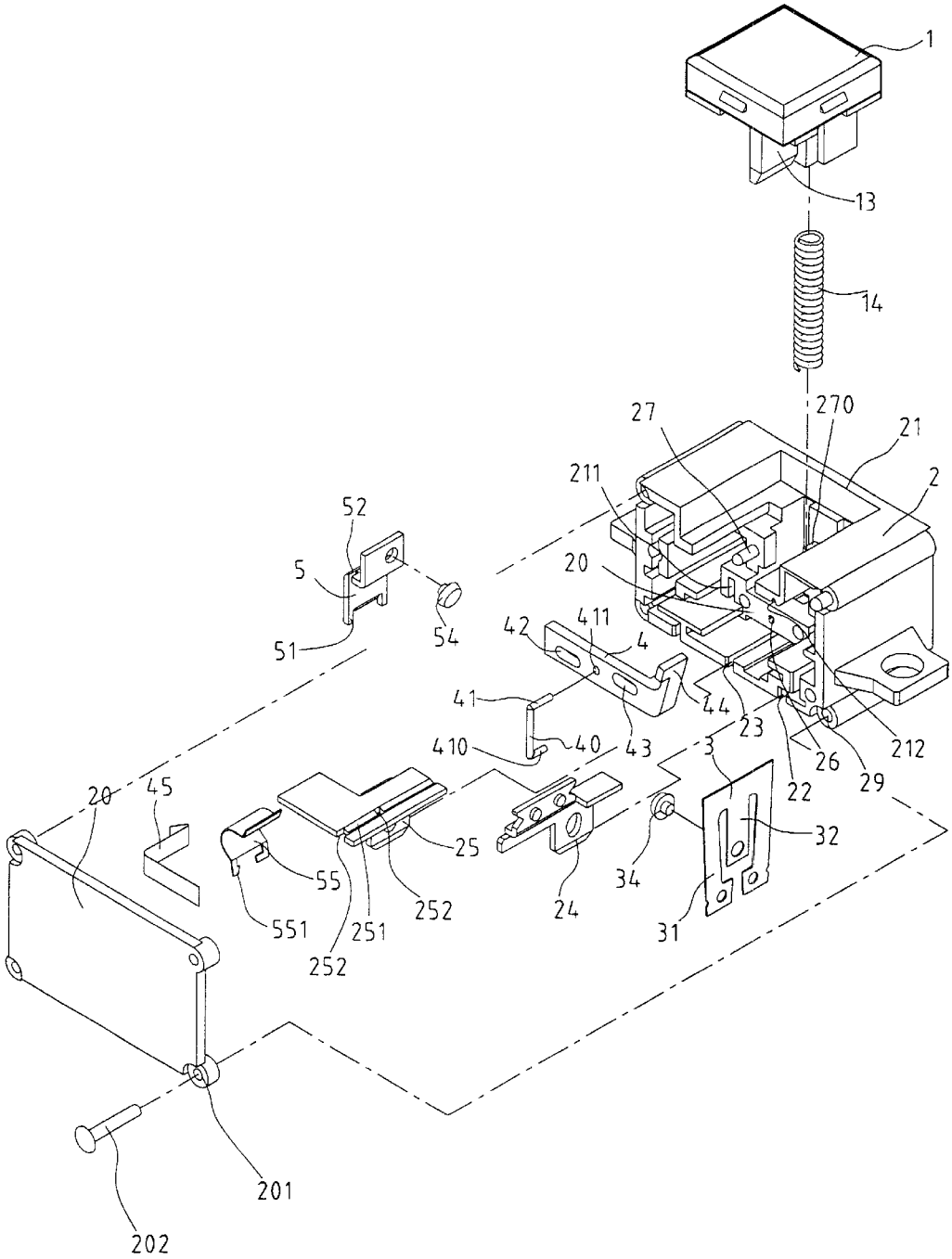
FIG. 1 is an exploded view to show the push button switch of the present invention.
Figure 2:
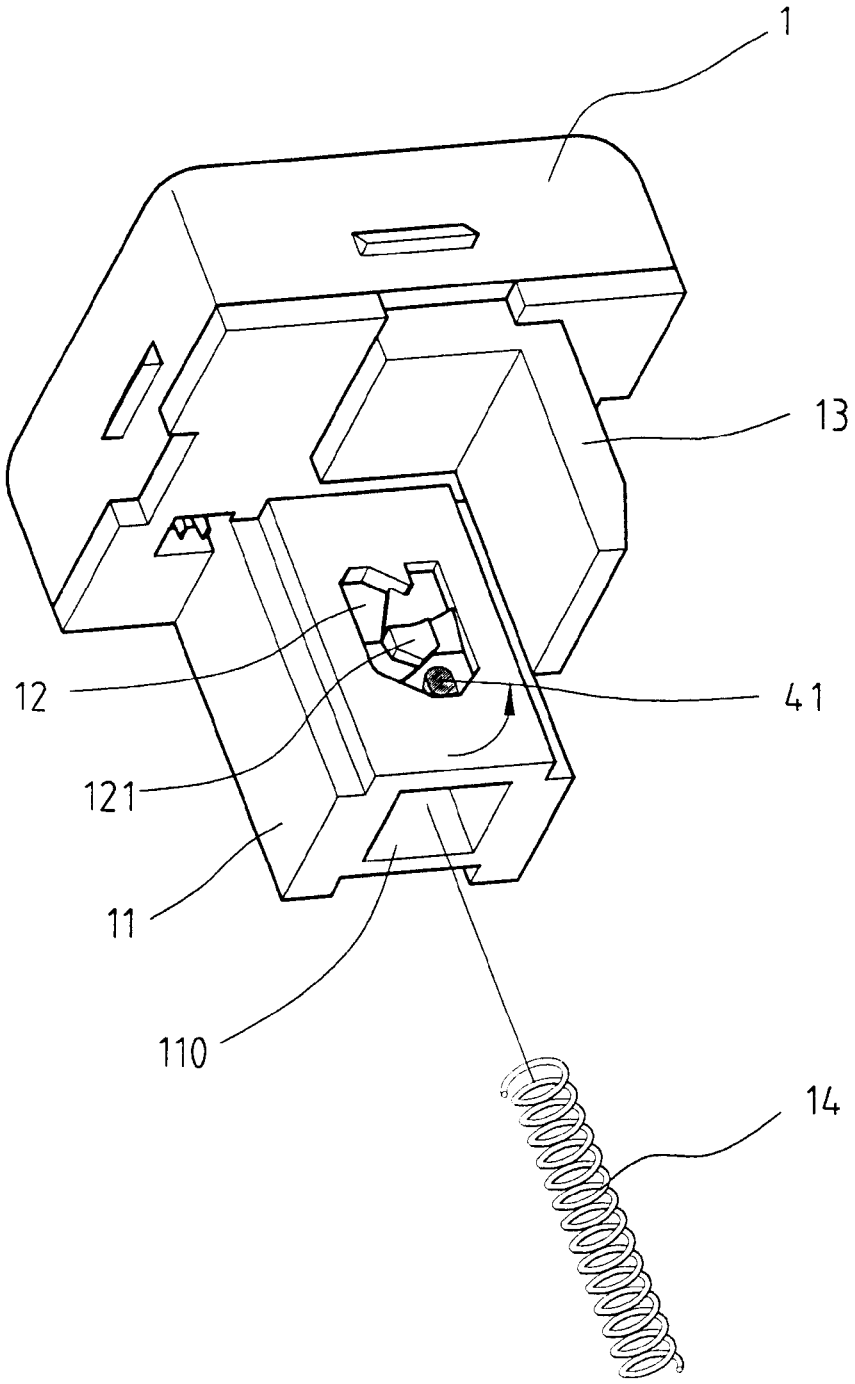
FIG. 2 is an exploded view to show a push button and a spring of the present invention.
Figure 3:
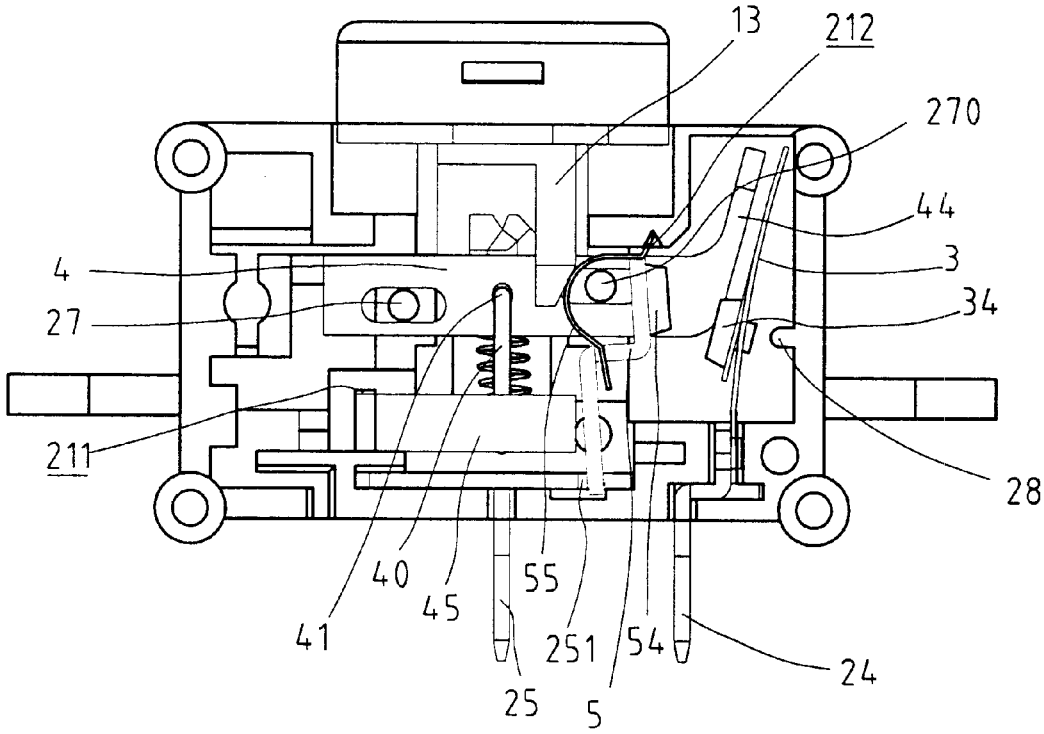
FIG. 3 is an illustrative view to show an open circuit status of the switch of the present invention.

Referring to FIGS. 1 to 3, the push button switch in accordance with the present invention comprises a box 2 having a button 1 movably inserted in an open top 21 of the box 2. A tubular member 11 extends from an underside of the button 1 and a hole 110 is defined in an underside of the tubular member 11 so as to receive one end of a spring 14 therein. The other end of the spring 14 contacts an inner side of the box 1. A tongue 13 extends from an underside of the button 1 and has an inclined surface. A recessed area 12 is defined in a surface of the tubular member 11 and the recessed area 12 has a polygonal inner periphery. A central member 121 is located in a center of the recessed area 12 and a dent 1210 is defined in a top of the central member 12. A triangle plate 122 extends from the inner periphery of the recessed area 12 and is located above the dent 1210 of the central member 12.

A first terminal plate 24 and a second terminal plate 25 respectively extend from two slits 22, 23 defined in a bottom of the box 2. A board 20 extends from an inner side of the box 2 and a hole 26 is defined in a surface of the board 20 and a recess 211 is defined in an underside of the board 20. Two rods 27, 270 respectively extend from the inner side of the box 2.

A movable member 4 has two slots 42, 43 defined therethrough and the two rods 27, 270 are movably received in the two slots 42, 43. A U-shaped member 40 has a leg 41 thereof extending through a hole 411 in the movable member 4 and is movably engaged with the recessed area 12. The other leg 410 of the U-shaped member 40 is inserted in the hole 26 in the board 20.

A U-shaped bimetal plate 3 has a central plate 32 located between two legs 31 of the U-shaped bimetal plate 3. A first contact point 34 is connected to the central plate 32 and the two legs 31 of the bimetal plate 3 are fixedly connected to a top of the first terminal plate 24. The bimetal plate 3 is located beside an end 44 of the movable member 4.

The second terminal plate 25 has a groove 251 defined in a top thereof and two notches 252 are defined through an inner periphery of the groove 251. A first end of the oscillation member 5 is pivotally received in the groove 251 and two protrusions 51 extend from the first end of the oscillation member 5, the two protrusions 51 engaged with the two notches 252. Accordingly, the oscillation member 5 is pivoted about the first end of the oscillation member 5. A second end of the oscillation member 5 has a second contact point 54 connected thereto. A curved spring 55 has an end fixedly received in a notch 212 of the board 20 and the other end of the curved spring 55 has two lugs 551 extending through slots 52 in the oscillation member 5. The inclined surface of the tongue 13 contacts the curved spring 55. An L-shaped spring 45 has one end engaged with the recess 211 and the other end of the L-shaped spring 45 pushes the U-shaped member 40 toward the recessed area 12 of the button 1. A cover 20 is connected to the box 2 to receive the parts mentioned above in the box 2 by screws or rivets 202 extending through holes 201 in the cover 20 and engaged with the holes 29 in the box 2.

Figures 6A, 6B, 6C, 6D:
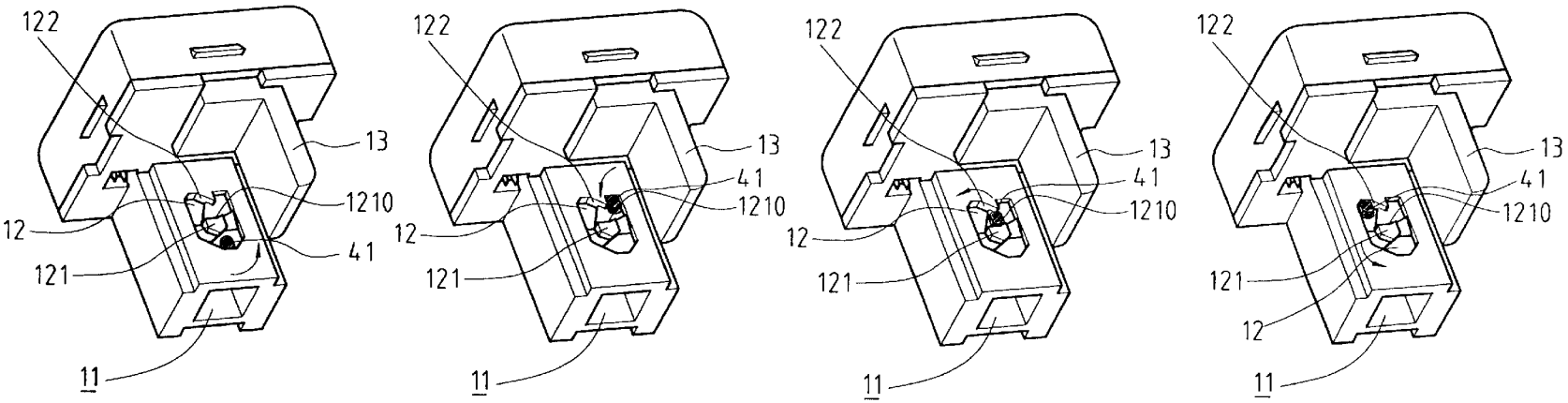
FIG. 6*a* shows the position of a leg of the U-shaped member in the recessed area of the push button when the circuit is in open position.
FIG. 6*b* shows the position of the leg of the U-shaped member in the recessed area of the push button when the button is pushed to close the circuit.
FIG. 6*c* shows the position of the leg of the U-shaped member in the recessed area of the push button when the circuit is in close position.
FIG. 6*d* shows the position of the leg of the U-shaped member in the recessed area of the push button when the button is pushed to open the circuit.

When the circuit is in open status, the button 1 is moved to the highest position by the spring 14 and the leg 41 is located at a lowest position in the recessed area 12 as shown in FIG. 6*a*.

Figure 4:
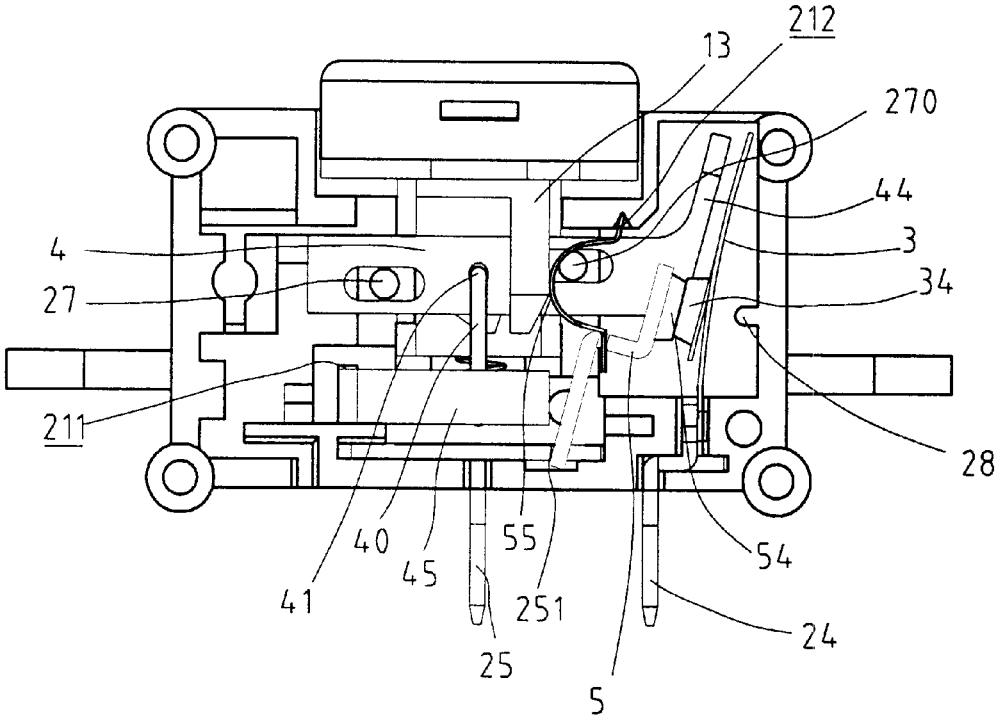
FIG. 4 is an illustrative view to show a close circuit status of the switch of the present invention.

As shown in FIG. 4, when the button 1 is pushed to close the circuit, the curved spring 55 is pushed by the downward movement of the tongue 13, the oscillation member 5 is then pivoted to let the second contact point 54 to contact the first contact point 34 to form a close circuit. In the mean while, referring to FIG. 6*b*, the leg 41 of the U-shaped member 40 is moved counter clockwise. When the user release the button 1, the button 1 slightly moves upward and the leg 41 is in the dent 1210 and located between the triangle plate 122 and the central member 121 as shown in FIG. 6*c*. When the button 1 is pushed again, the circuit will be opened and the leg 41 is moved as shown in FIG. 6*d*.

Figure 5:
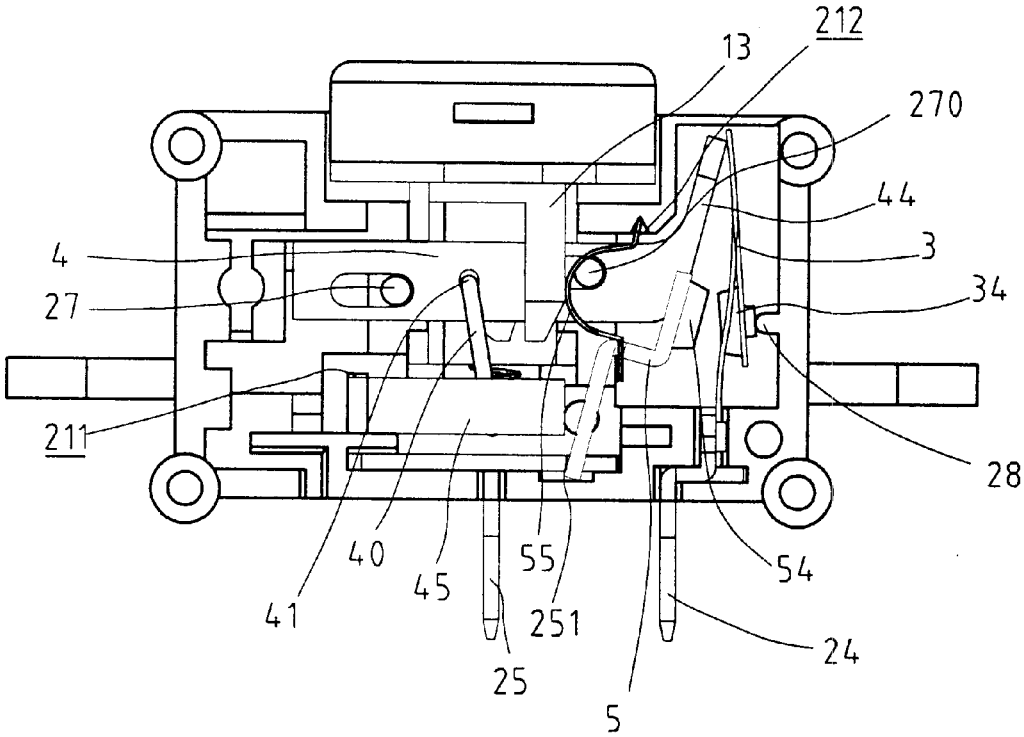
FIG. 5 is an illustrative view to show an open circuit status of the switch of the present invention when the bimetal plate is deformed in case of the override.
Figure 7A:
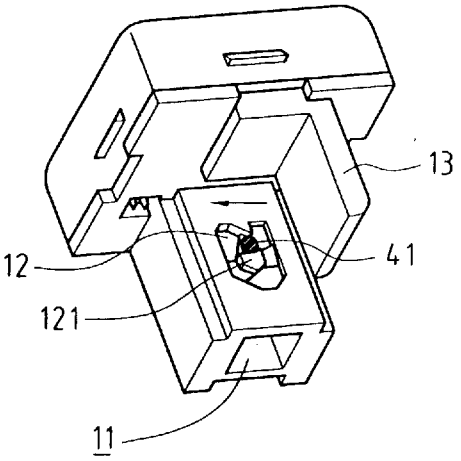
FIG. 7*a* shows that when the metal plate is to be deformed, the leg of the U shaped member is still in the close circuit position the same as that shown in FIG. 6*c*.
Figure 7B:
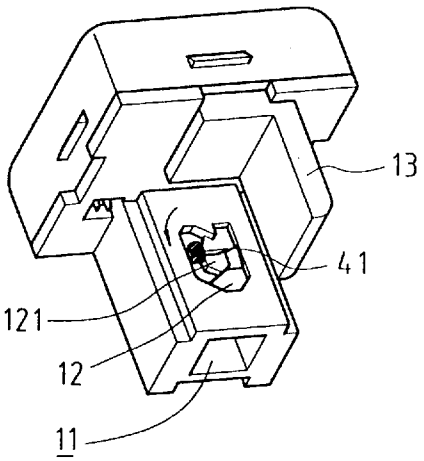
FIG. 7*b* shows that when the metal plate is deformed, the leg of the U-shaped member is shifted left.

FIG. 5 shows that the bimetal plate 3 is deformed in case of the override, a top of the bimetal plate 3 is deformed toward the left to push the end 44 of the movable member 4, and the second contact point 54 and the first contact point 34 are separated. The leg 41 of the U-shaped member 40 is then shifted from the position in FIG. 7*a* to the position in FIG. 7*b*. A boss 28 extends from an inside of the box 1 and contacts the central plate 32 of the bimetal plate 3 when the bimetal plate 3 is deformed. The boss 28 prevents the central plate 32 of the bimetal plate 3 from being over deformed.

Figure 7C:
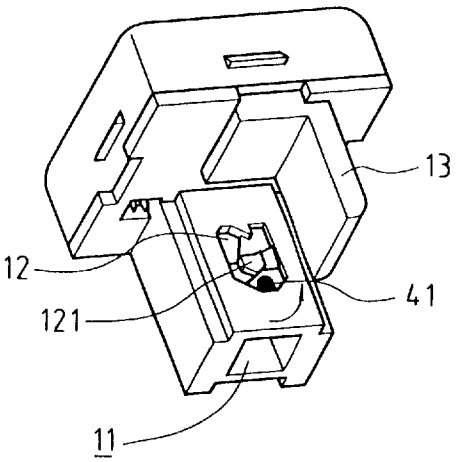
FIG. 7*c* shows that when the metal plate is deformed and the circuit is opened, the button jumps up and the leg of the U-shaped member is located at the position the same as that shown in FIG. 6*a*.

When the button 1 jumps up, the leg 41 of the U-shaped member 40 is moved to the position as shown in FIG. 7*c*.

While we have shown and described various embodiments in accordance with the present invention, it should be clear to those skilled in the art that further embodiments may be made without departing from the scope and spirit of the present invention.

What is claimed is:

1. A push button switch comprising:

a box having a button movably inserted in an open top of said box, a tubular member extending from an underside of said button and a spring biased between said tubular member and said box, a tongue extending from an underside of said button and a recessed area defined in a surface of said tubular member, said recessed area having a polygonal inner periphery and a central member located in a center of said recessed area, a first terminal plate and a second terminal plate respectively extending from a bottom of said box, a board extending from an inner side of said box and a hole defined in a surface of said board, two rods respectively extending from said inner side of said box;

a movable member having two slots defined therethrough and said two rods movably received in said two slots, a U-shaped member having a leg thereof extending through said movable member and movably engaged with said recessed area, the other leg of said U-shaped member inserted in said hole in said board;

a U-shaped bimetal plate having a central plate located between two legs of said U-shaped bimetal plate, a first contact point connected to said central plate and said two legs of said bimetal plate fixedly connected to a top of said first terminal plate, said bimetal plate located beside an end of said movable member, and an oscillation member having a first end pivotally connected to said second terminal plate and a second end of said oscillation member having a second contact point connected thereto, a curved spring having an end fixedly connected to said box and the other end of said curved spring connected to said oscillation member, said tongue contacting said curved spring.

2. The switch as claimed in claim 1, wherein said second terminal plate has two notches defined in a top thereof and two protrusions extend from said first end of said oscillation member, said two protrusions engaged with said two notches.

3. The switch as claimed in claim 2, wherein said second terminal plate has a groove defined in said top thereof and said first end of said oscillation member pivotally received in said groove.

4. The switch as claimed in claim 1, further comprising a recess defined in an underside of said board and an L-shaped spring has one end engaged with said recess, the other end of said L-shaped spring pushing said U-shaped member toward said recessed area of the button.

5. The switch as claimed in claim 1, further comprising an inclined surface defined in said tongue and said inclined surface contacting said curved spring.

6. The switch as claimed in claim 1, wherein said tubular member has a hole defined in an underside thereof so as to receive one end of said spring therein.

7. The switch as claimed in claim 1, further comprising a dent defined in a top of said central member and a triangle plate extends from said inner periphery of said recessed area, said triangle plate located above said dent of said central member.

8. The switch as claimed in claim 1, further comprising a boss extending from an inside of said box and contacting said central plate of said bimetal plate when said bimetal plate is deformed.

* * * * *